US010384333B2

(12) United States Patent
Lai

(10) Patent No.: US 10,384,333 B2
(45) Date of Patent: Aug. 20, 2019

(54) RATCHET WRENCH

(71) Applicant: Shih-Hao Lai, Taichung (TW)

(72) Inventor: Shih-Hao Lai, Taichung (TW)

( * ) Notice: Subject to any disclaimer, the term of this patent is extended or adjusted under 35 U.S.C. 154(b) by 397 days.

(21) Appl. No.: 15/207,534

(22) Filed: Jul. 12, 2016

(65) Prior Publication Data

US 2018/0015595 A1 Jan. 18, 2018

(51) Int. Cl.
*B25B 13/46* (2006.01)

(52) U.S. Cl.
CPC ..... *B25B 13/463* (2013.01)

(58) Field of Classification Search
CPC ..... B25B 13/463
See application file for complete search history.

(56) References Cited

U.S. PATENT DOCUMENTS 2,957,377 A * 10/1960 Hare ..... B25B 13/463 192/43.2
3,265,171 A * 8/1966 Kilness ..... B25B 13/463 192/43.2
6,282,991 B1 * 9/2001 Hu ..... B25B 13/463 81/60
6,520,051 B1 * 2/2003 Hu ..... B25B 13/463 81/60
8,806,986 B2 * 8/2014 Chen ..... B25B 1/02 81/62
9,782,873 B2 10/2017 Chi
2002/0023519 A1 * 2/2002 Hu ..... B25B 13/463 81/63.2
2004/0200322 A1 10/2004 Hu
2006/0123954 A1 * 6/2006 Arnold ..... B25B 13/463 81/63
2013/0291688 A1 * 11/2013 Hu ..... B25B 13/463 81/63.1

FOREIGN PATENT DOCUMENTS

DE 10238793 A1 3/2003
TW M511925 U 11/2015
TW I526282 B 3/2016
TW 201615353 A 5/2016

* cited by examiner

*Primary Examiner* — Joseph J Hail
*Assistant Examiner* — J Stephen Taylor
(74) *Attorney, Agent, or Firm* — Alan D. Kamrath; Mayer & Williams PC

(57) ABSTRACT

A ratchet wrench includes a body, a ratchet wheel rotatably and movably mounted in the body, and a pawl slideably received in the body and engaged with the ratchet wheel. The body is extended along a first longitudinal axis, and the ratchet wheel is extended along a second longitudinal axis. The ratchet wrench is operable between a first position and a second position. When the ratchet wrench is in the first position, the first and second longitudinal axes are collinear. When the ratchet wrench is operated to withstand a torque load and to move from the first position to a second position, the first and second longitudinal axes are parallel to each other.

10 Claims, 8 Drawing Sheets

RATCHET WRENCH

BACKGROUND OF THE INVENTION

The present invention relates to a ratchet wrench and, more particularly, to a reversible ratchet wrench.

A typical ratchet wrench is used for quickly turning an object, such as a rotary fastener. The ratchet wrench connects a socket and allows the socket to be turned without removing it from the fastener simply by cycling the handle backward and forward for repeatedly turning the fastener.

A ratchet wheel and a pawl of the ratchet wrench are repeatedly engaged and disengaged with each other for driving or non-driving the fastener. However, when the teeth of the ratchet wheel and the teeth of the pawl are not completely engaged with each other, and when the user immediately rotates the ratchet wrench in a driving direction and a non-driving direction, the teeth of the ratchet wheel and the pawl will be damaged easily. This is because the teeth of the ratchet wheel and the teeth of the pawl just engage each other in a small contact area, which is not enough to withstand a bigger torque load. If the teeth of the ratchet wheel and the pawl are small, they are more easily damaged because of a smaller contact area formed between the teeth of the ratchet wheel and the pawl.

Thus, a need exists for a novel ratchet wrench that mitigates and/or obviates the above disadvantages.

BRIEF SUMMARY OF THE INVENTION

This need and other problems in the field of durable reversible ratchet wrenches are solved by a ratchet wrench comprising:

a body including a head having first and second receiving recesses interconnected with each other, with the first receiving recess extended along a first longitudinal axis, with the second receiving recess having a first abutting face;

a ratchet wheel rotatably and movably mounted in the first receiving recess and extended along a second longitudinal axis, with the ratchet wheel including a plurality of first toothed portions; and a pawl slideably received in the second receiving recess and including a plurality of second toothed portions and a first contact face, with the plurality of second toothed portions disengageably engaged with the plurality of first toothed portions, with the first contact face abutting against the first abutting face of the second receiving recess;

when the ratchet wrench operable between a first position and a second position;

when the ratchet wrench is in the first position, the first and second longitudinal axes are collinear, the first contact face abuts against the first abutting face, and the plurality of second toothed portions of the pawl is engaged with the plurality of first toothed portions of the ratchet wheel;

when the ratchet wrench is operated to withstand a torque load and to move from the first position to a second position, the pawl slides along the first abutting face from one side of the second receiving recess to another side of the second receiving recess adjacent to the first abutting face, the ratchet wheel is pushed by the pawl, the first and second longitudinal axes are parallel to each other, and the pawl is limited between the ratchet wheel and the first abutting face.

A first gap is formed between the first abutting face of the second receiving recess and the first contact face of the pawl. The first gap is gradually expanded from one end of the first abutting face to another end of the first abutting face adjacent to the ratchet wheel. A first hardness of the body and a second hardness of the ratchet wheel are both greater than a third hardness of the pawl. The ratchet wrench is further operable in a third position. When the ratchet wrench is in the first position or the second position, the first gap is formed between the first abutting face and first contact face. When the ratchet wrench is in a third position, the pawl is compressed between the first abutting face and the ratchet wheel to be elastically deformed, and the first abutting face abuts against the first contact face to remove the first gap.

The body further includes a handle connected to the head. The handle is extended along a horizontal axis. The first abutting face is curvely extended about a first centre. The horizontal axis extends through the first centre. The first contact face is curvely extended about a second centre, and the first contact face and the second centre are respectively disposed at two opposite sides of the horizontal axis. When the ratchet wrench is in the first position, the first contact face linearly contacts with the first abutting face along a thickness direction of the pawl.

A first distance formed between the first contact face and the second centre is greater than a second distance formed between the first abutting face and the first centre.

The second receiving recess further has a second abutting face. The first and second abutting faces are respectively disposed at two opposite sides of the second receiving recess. The pawl further includes a second contact face. The plurality of second toothed portions is disposed between the first and second contact faces. The second contact face abuts against the second abutting face of the second receiving recess. A second gap is formed between the second abutting face of the second receiving recess and the second contact face of the pawl. The second gap is gradually expanded from one end of the second abutting face to another end of the second abutting face adjacent to the ratchet wheel. The pawl abuts against the first abutting face or the second abutting face of the second receiving recess to change a driving direction and a non-driving direction of the body. The ratchet wheel and a fastener are coupled to the ratchet wheel adapted to rotate jointly with the body while the body rotates in the driving direction. The fastener is coupled to the ratchet wheel adapted to remain still when the body rotates in the non-driving direction.

The head further has a third receiving recess interconnected with the second receiving recess. The second receiving recess is arranged between the first and third receiving recesses.

The ratchet wrench further comprises a reversible device including a switch button pivotally received in the third receiving recess, a first elastic member, and a pressing member, with the switch button including a receptacle, with the first elastic member and the pressing member received in the receptacle, and with the pressing member biased by the first elastic member to press against a side of the pawl opposite to the ratchet wheel.

The pawl further includes a guiding groove arranged at one side thereof adjacent to the third receiving recess and located between the first and second contact faces. The guiding groove includes a first recessed portion disposed adjacent to the first contact face, and a second recessed portion disposed adjacent to the second contact face. The pressing member is capable of pressing against the first recessed portion or the second recessed portion to abut the pawl against the first abutting face or the second abutting face of the second receiving recess.

The switch button includes a positioning portion extended therefrom. The positioning portion abuts against two opposite ends of the second receiving recess adjacent to the third receiving recess to limit a pivoting angle of the switch button while the switch button is operable to pivot relative to the head.

The switch button further includes two abutting surfaces disposed at one side thereof opposite to the second receiving recess. The two abutting surfaces are perpendicular to each other. The head further includes a slot interconnected with the third receiving recess. The reversible device further includes a second elastic member and an abutting member received in the slot. The abutting member is biased by the second elastic member to press against one of the two abutting surfaces.

The guiding groove further includes a first restricting edge, a second restricting edge, and a bulge portion. The first and second recessed portions are disposed between the first and second restricting edges. The first and second restricting edges and the bulge portion are extended toward the reversible device. The pressing member is limited by the first and second restricting edges to be unable to disengage from the first recessed portion or the second recessed portion.

Illustrative embodiments will become clearer in light of the following detailed description described in connection with the drawings.

DESCRIPTION OF THE DRAWINGS

The illustrative embodiments may best be described by reference to the accompanying drawings where.

Figure 1:
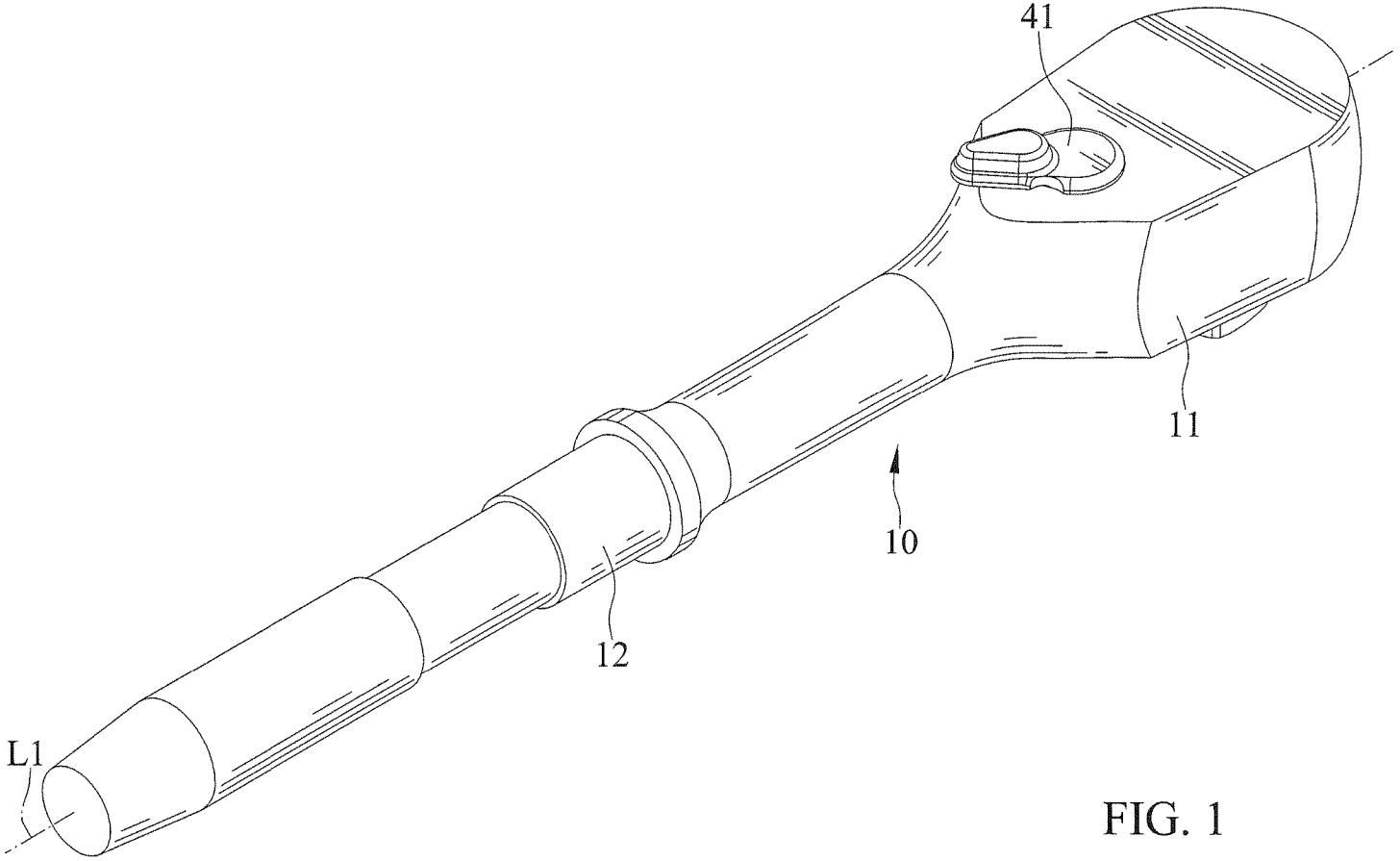
FIG. 1 is a perspective view of a ratchet wrench according to the present invention.
Figure 2:
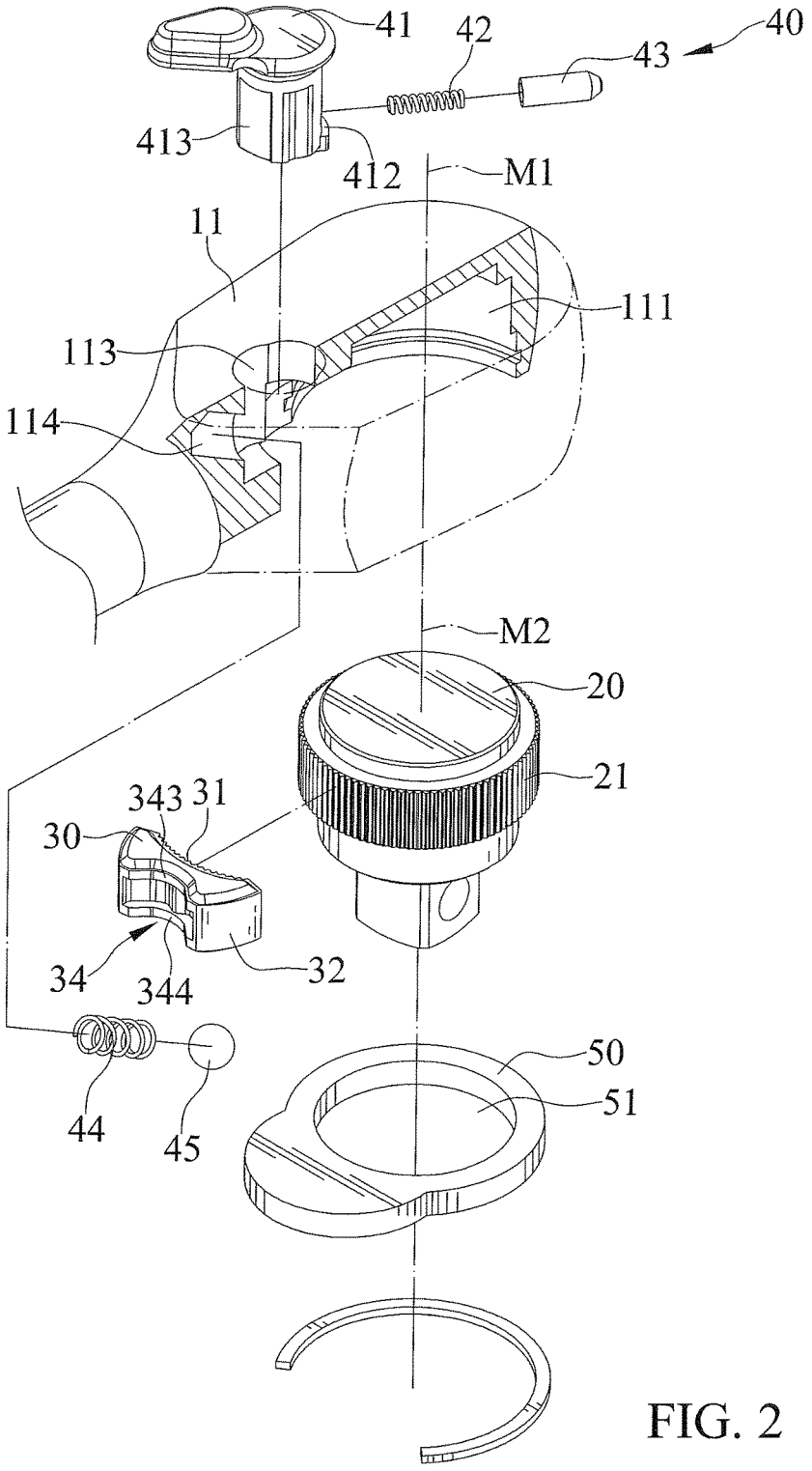
FIG. 2 is a partial, exploded, perspective view of the ratchet wrench of FIG. 1.
Figure 3:
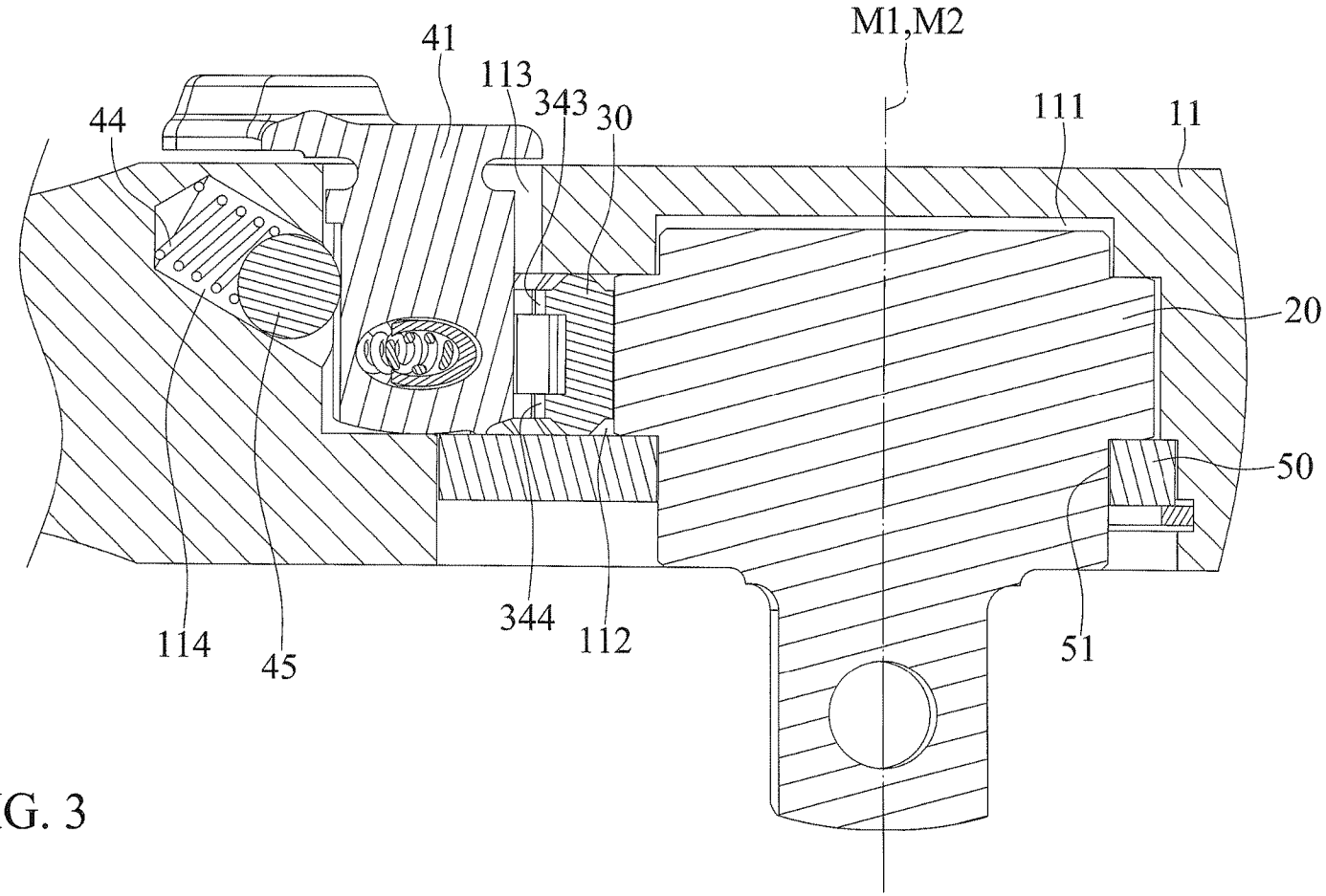
FIG. 3 is a partial, cross sectional view of the ratchet wrench of FIG. 1.

All figures are drawn for ease of explanation of the basic teachings only; the extensions of the figures with respect to number, position, relationship, and dimensions of the parts to form the illustrative embodiments will be explained or will be within the skill of the art after the following teachings have been read and understood. Further, the exact dimensions and dimensional proportions to conform to specific force, weight, strength, and similar requirements will likewise be within the skill of the art after the following teachings have been read and understood.

Where used in the various figures of the drawings, the same numerals designate the same or similar parts. Furthermore, when the terms "first", "second", "bottom", "side", "end", "portion", "spacing", "length", "width", "thickness", and similar terms are used herein, it should be understood that these terms have reference only to the structure shown in the drawings as it would appear to a person viewing the drawings and are utilized only to facilitate describing the illustrative embodiments.

DETAILED DESCRIPTION OF THE INVENTION

FIGS. 1-8 show a ratchet wrench according to the present invention. The ratchet wrench includes a body 10, a ratchet wheel 20 adapted for driving a fastener, a pawl 30 engaged with the ratchet wheel 20, and a reversible device 40 pivotally mounted to the body 10 for pressing the pawl 30.

The body 10 includes a head 11 having first and second receiving recesses 111 and 112 interconnected with each other. The first receiving recess 111 extended along a first longitudinal axis M1. The second receiving recess 112 has a first abutting face 1121 and a second abutting face 1122 respectively disposed at two opposite sides of the second receiving recess 112. The first abutting face 1121 is curvely extended about a first centre C1.

The head 11 further has a third receiving recess 113 interconnected with the second receiving recess 112. The second receiving recess 112 is arranged between the first and third receiving recesses 111 and 113. The head 11 further includes a slot 114 interconnected with the third receiving recess 113.

The body 10 further includes a handle 12 connected to the head 11. The handle 12 is extended along a horizontal axis L1 extending through the first centre C1.

The ratchet wheel 20 is rotatably and movably mounted in the first receiving recess 111 and is extended along a second longitudinal axis M2. Therefore, when the ratchet wheel 20 is assembled into the first receiving recess 111, the first and second longitudinal axes M1 and M2 are collinear. The ratchet wheel 20 includes a plurality of first toothed portions 21 disposed around the circumference of the ratchet wheel 20.

The pawl 30 is slideably received in the second receiving recess 112. In the embodiment, a first hardness of the body 10 and a second hardness of the ratchet wheel 20 are both greater than a third hardness of the pawl 30. The pawl 30 includes a plurality of second toothed portions 31 and a first contact face 32. The plurality of second toothed portions 31 is engaged with the plurality of first toothed portions 21. The first contact face 32 abuts against the first abutting face 1121 of the second receiving recess 112. The first contact face 32 is curvely extended about a second centre C2, and the first contact face 32 and the second centre C2 are respectively disposed at two opposite sides of the horizontal axis L1.

The pawl 30 further includes a second contact face 33. The plurality of second toothed portions 31 is disposed between the first and second contact faces 32 and 33. The second contact face 33 abuts against the second abutting face 1122 of the second receiving recess 112.

The first and second contact faces 32 and 33 of the pawl 30 respectively abuts against the first abutting face 1121 or the second abutting face 1122 of the second receiving recess 112 to change a driving direction and a non-driving direction of the body 10.

The fastener coupled to the ratchet wheel 20 is adapted to rotate jointly with the body 10 while the body 10 rotates in the driving direction. The fastener coupled to the ratchet wheel 20 is adapted to remain still when the body 10 rotates in the non-driving direction.

When the first contact face 32 abuts against the first abutting face 1121 of the second receiving recess 112, a first gap A is formed between the first abutting face 1121 of the second receiving recess 112 and the first contact face 32 of the pawl 30. The first gap A is gradually expanded from one end of the first abutting face 1121 to another end of the first abutting face 1121 adjacent to the ratchet wheel 20.

When the second contact face 33 abuts against the second abutting face 1122 of the second receiving recess 112, a second gap A1 is formed between the second abutting face 1122 of the second receiving recess 112 and second contact face 33 of the pawl 30. The second gap A1 is gradually expanded from one end of the second abutting face 1122 to another end of the second abutting face 1122 adjacent to the ratchet wheel 20.

In the embodiment, a first distance formed between the first contact face 32 and the second centre C2 is greater than a second distance formed between the first abutting face 1121 and the first centre C1. In a preferred form, the first distance is 1.1 times as long as the second distance, so that the first contact face 32 can linearly contact with the first abutting face 1121 along a thickness direction of the pawl 30. Likewise, the second contact face 33 can linearly contact with the second abutting face 1122 along the thickness direction of the pawl 30.

The pawl 30 further includes a guiding groove 34 arranged at one side thereof adjacent to the third receiving recess 113 and located between the first and second contact faces 32 and 33. The guiding groove 34 includes a first recessed portion 341 disposed adjacent to the first contact face 32, and a second recessed portion 342 disposed adjacent to the second contact face 33.

The guiding groove 34 further includes a first restricting edge 343, a second restricting edge 344, and a bulge portion 345. The first and second recessed portions 341 and 342 are disposed between the first and second restricting edges 343 and 344. The first and second restricting edges 343 and 344, and the bulge portion 345 are extended toward the reversible device 40.

The reversible device 40 includes a switch button 41 pivotally received in the third receiving recess 113, a first elastic member 42, and a pressing member 43. The switch button 41 includes a receptacle 411 and a positioning portion 412 extended therefrom. The positioning portion 412 detachably abuts against two opposite ends of the second receiving recess 112 adjacent to the third receiving recess 113 to limit a pivoting angle of the switch button 41 while the switch button 41 is operable to pivot relative to the head 11. The switch button 41 further includes two abutting surfaces 413 disposed at one side thereof opposite to the second receiving recess 112. The two abutting surfaces 413 are perpendicular to each other. The first elastic member 42 and the pressing member 43 are received in the receptacle 411. The pressing member 43 is biased by the first elastic member 42 to press against a side of the pawl 30 opposite to the ratchet wheel 20. The pressing member 43 is capable of pressing against the first recessed portion 341 or the second recessed portion 342 to cause the pawl 30 abutting against the first abutting face 1121 or the second abutting face 1122 of the second receiving recess 112. The pressing member 43 is limited by the first and second restricting edges 343 and 344 to be unable to disengage from the first recessed portion 341 or the second recessed portion 342.

The reversible device 40 further includes a second elastic member 44 and an abutting member 45 received in the slot 114. The abutting member 45 is biased by the second elastic member 44 to press against one of the two abutting surfaces 413.

The ratchet wrench further includes a cap 50 connected to the body 10 by a C-ring to prevent the ratchet wheel 20 and the pawl 30 from being disengaged from the first and second receiving recesses 111 and 112. The cap 50 includes a through-hole 51 extended through two opposite ends thereof along the first longitudinal axis M I. The ratchet wheel 20 is movably inserted through the through-hole 51.

Figure 4:
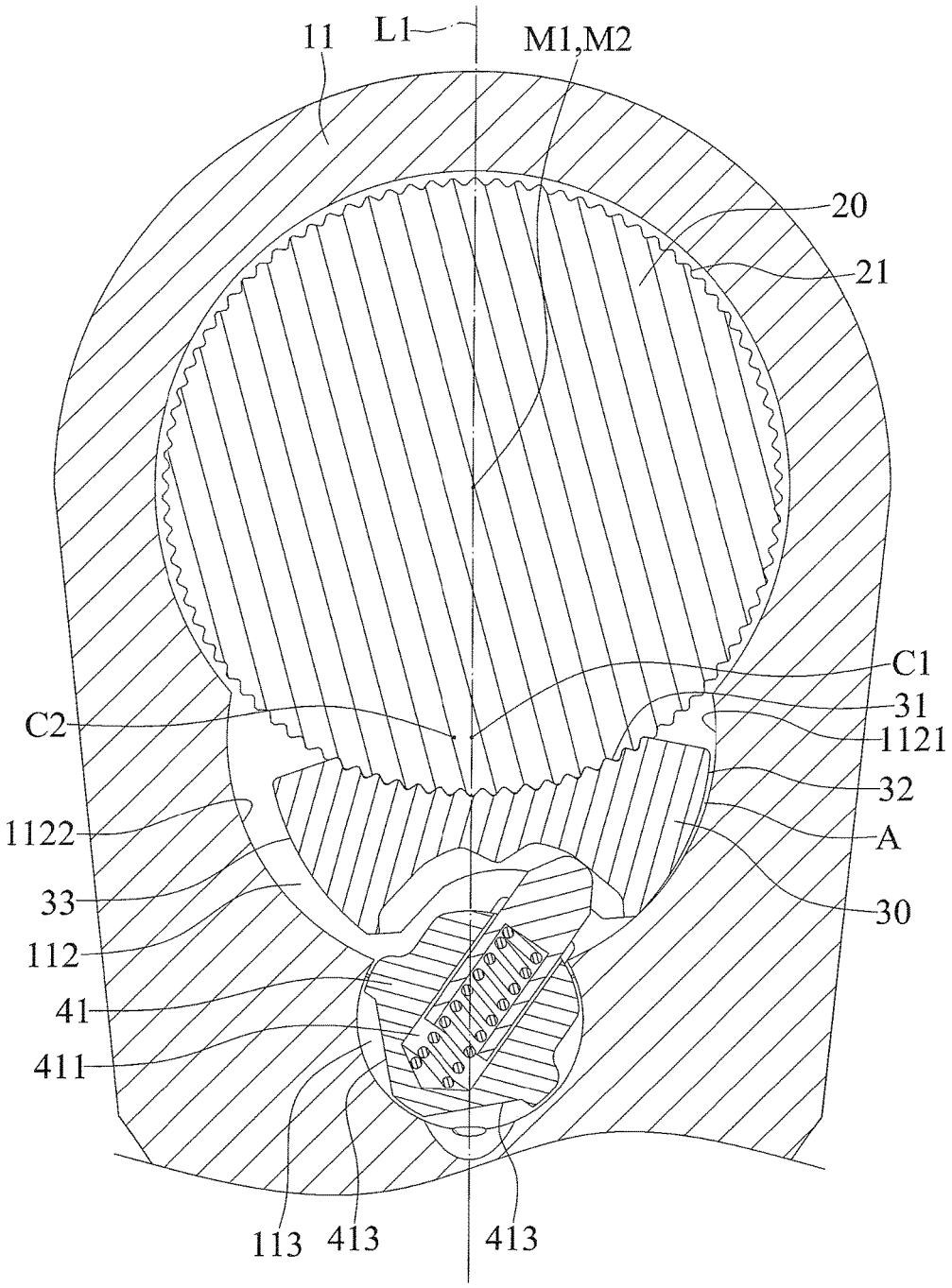
FIG. 4 is another partial, cross sectional view of the ratchet wrench, illustrating the ratchet wrench in a first position.
Figure 5:
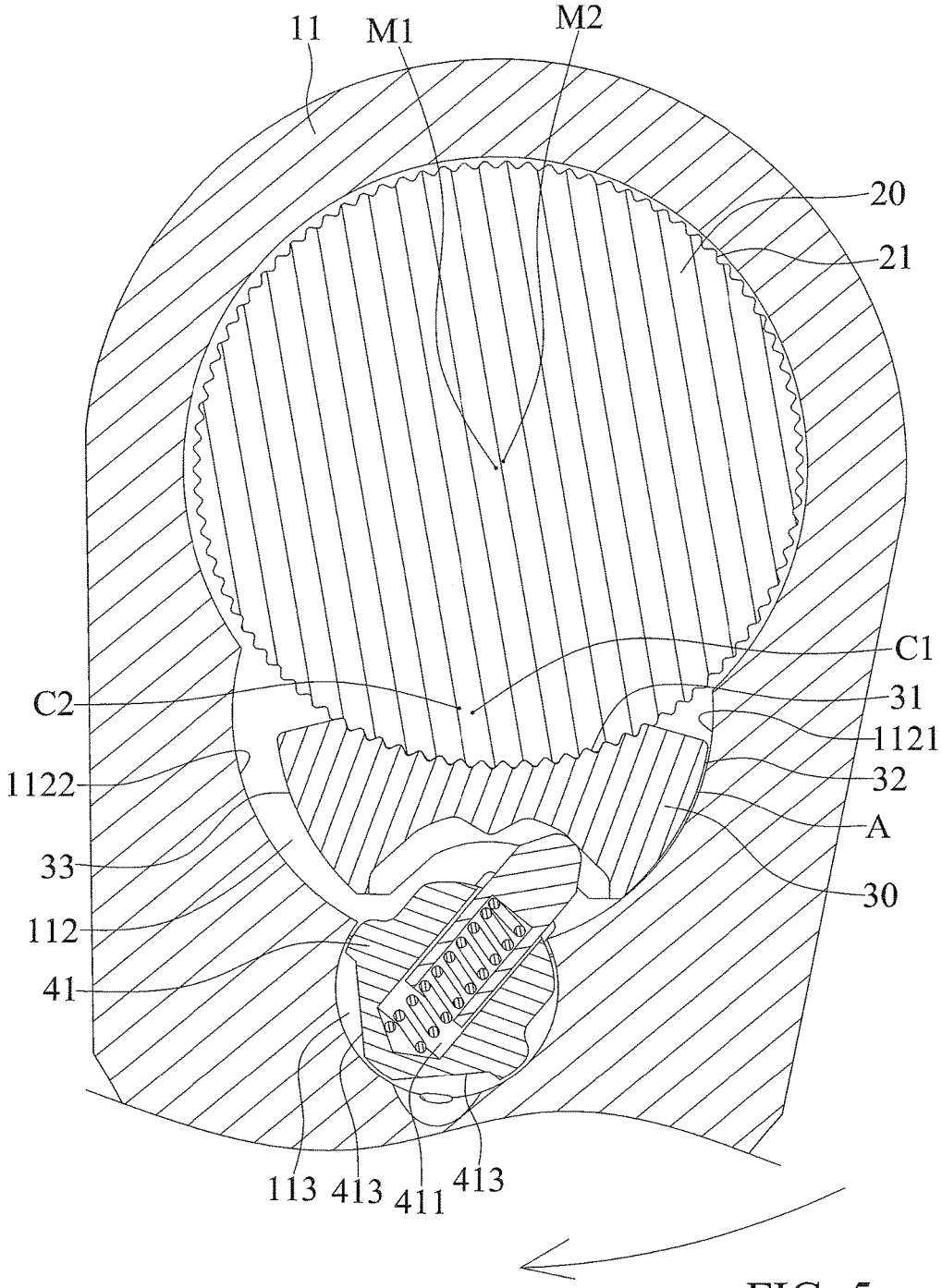
FIG. 5 is a continued view of FIG. 4, illustrating a body rotating in a driving direction indicated by an arrow to cause the ratchet wrench to be operated front the first position to a second position.
Figure 6:
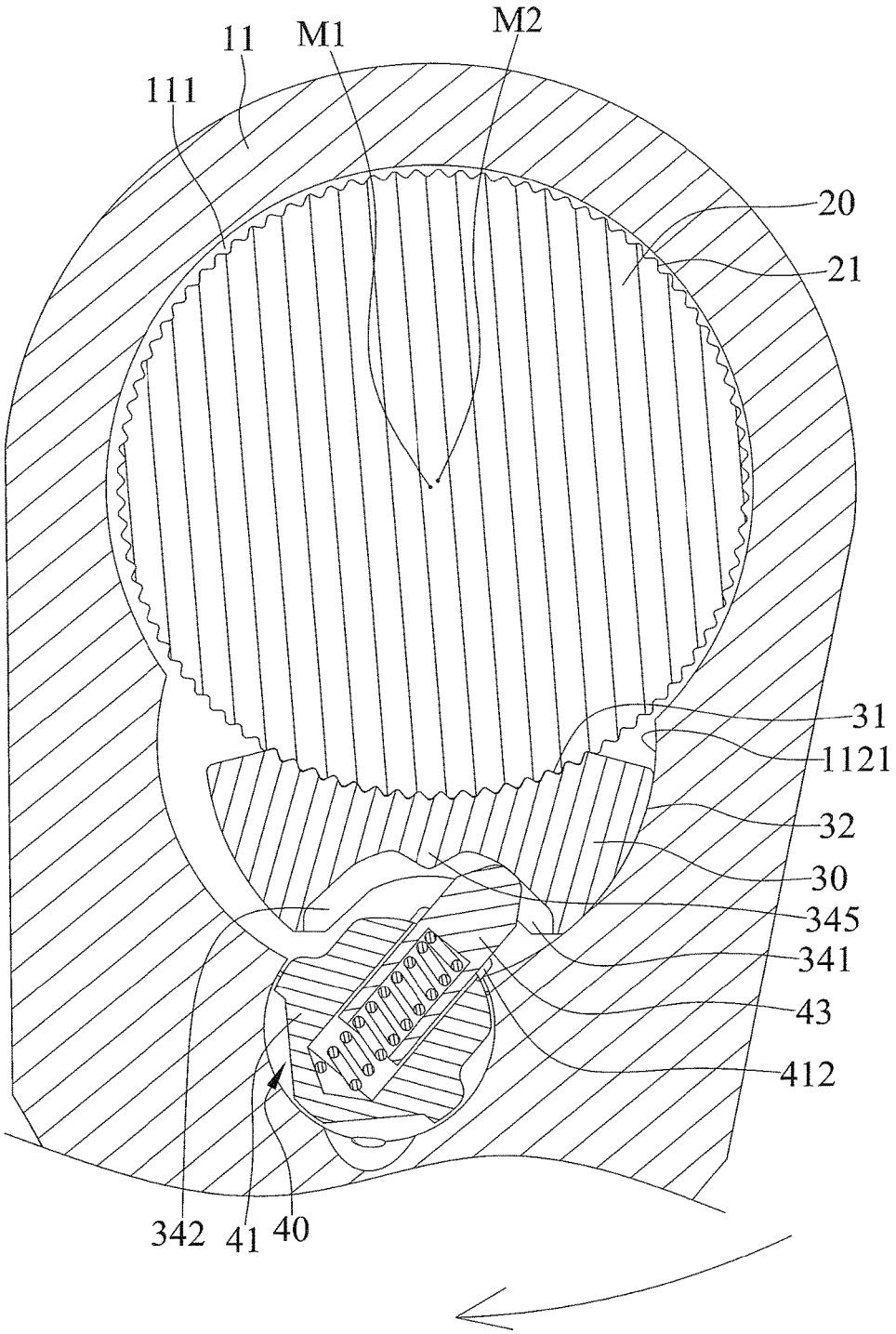
FIG. 6 is a continued view of FIG. 5, illustrating the body further continuously rotating in the driving direction indicated by the arrow to cause the ratchet wrench to be operated from the second position to a third position.

The ratchet wrench is operable between a first position (as shown in FIG. 4), a second position (as shown in FIG. 5), and a third position (as shown in FIG. 6).

When user does not rotate the ratchet wrench, the ratchet wrench is in the first position. In other words, the ratchet wrench does not withstand any external force in the first position.

When the ratchet wrench is in the first position, the first and second longitudinal axes M1 and M2 are collinear. The pressing member 43 presses against the guiding groove 34 of the pawl 30. The plurality of second toothed portions 31 of the pawl 30 is engaged with the plurality of first toothed portions 21 of the ratchet wheel 20. The first contact face 32 can linearly abut against the first abutting face 1121 along the thickness direction of the pawl 30. The first gap A is formed between the first abutting face 1121 of the second receiving recess 112 and the first contact face 32 of the pawl 30.

When the ratchet wrench is operated in the driving direction to withstand a torque load and to move from the first position to a second position, the pawl 30 slides along the first abutting face 1121 from one side of the second receiving recess 112 to another side of the second receiving recess 112 adjacent to the first abutting face 1121. The ratchet wheel 20 is pushed by the pawl 30 to move in the first receiving recess 111 until the ratchet wheel 20 abuts against an inner periphery of the through-hole 51 of the cap 50, so that the first and second longitudinal axes M1 and M2 are parallel to each other. The pawl 30 is limited between the ratchet wheel 20 and the first abutting face 1121 and cannot slide toward the third receiving recess 113 quickly. Thus, the plurality of second toothed portions 31 of the pawl 30 can be completely and firmly engaged with the plurality of first toothed portions 21 of the ratchet wheel 20 to withstand the torque load and to prevent damaging the first and second toothed portions 21 and 31.

When the body 10 continuously rotates in the driving direction to move from the second position to a third position, the ratchet wrench withstands a higher torque load. The pawl 30 is compressed between the first abutting face 1121 and the ratchet wheel 20 to be elastically deformed. The first gap A gradually reduces until the first abutting face 1121 abuts against the first contact face 32 to remove the first gap A. The first contact face 32 facely contacts with the first abutting face 1121. The first and second longitudinal axes M1 and M2 are parallel to each other. The pawl 30 is compressed between the first abutting face 1121 and the ratchet wheel 20, so that the plurality of second toothed portions 31 of the pawl 30 can be completely and firmly engaged with the plurality of first toothed portions 21 of the ratchet wheel 20 to withstand the higher torque load and to prevent damaging the first and second toothed portions 21 and 31. The pressing member 43 is biased by the first elastic member 42 to press against the pawl 30 to abut the second contact face 33 against the second abutting face 1122.

Figure 7:
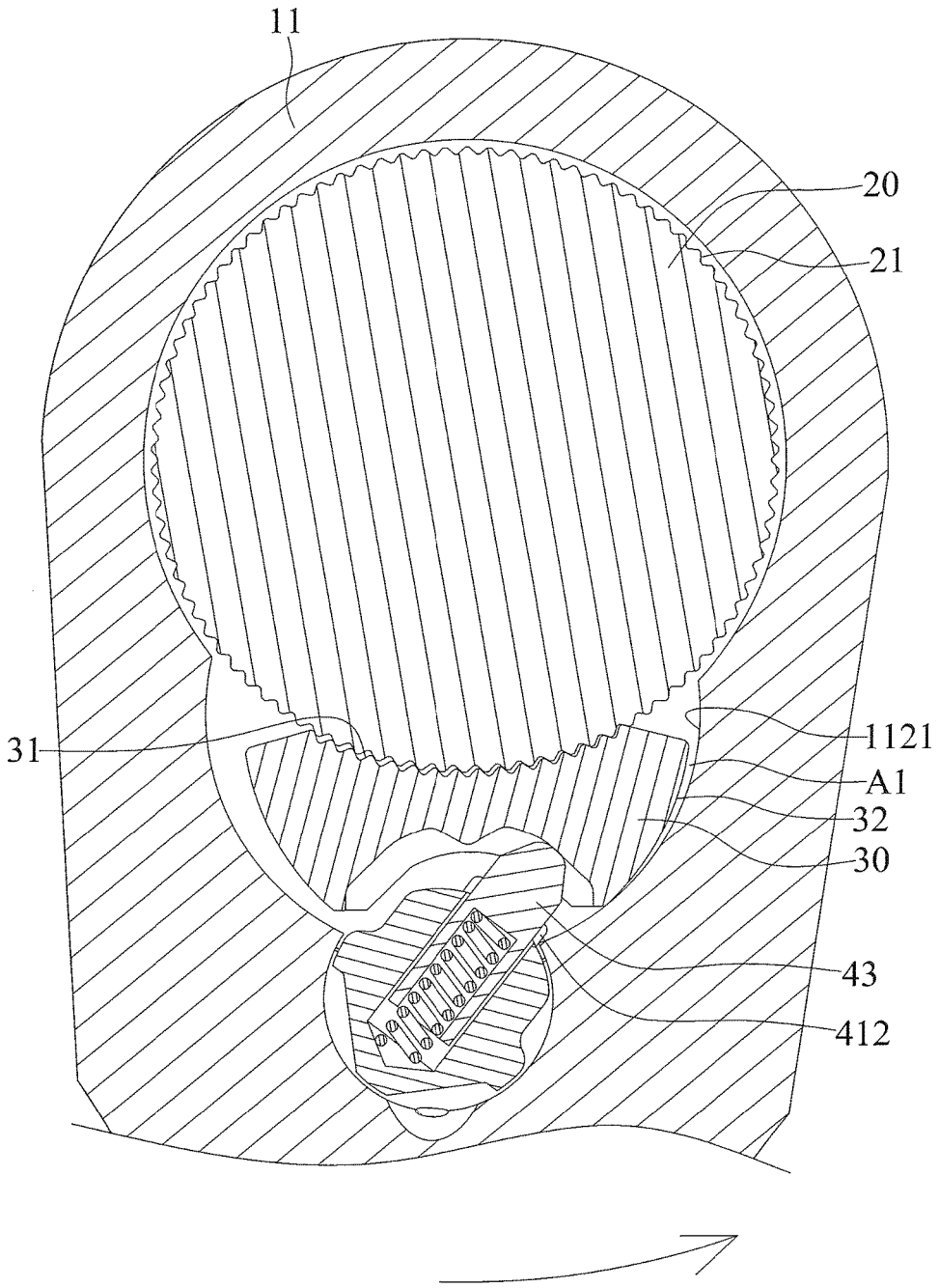
FIG. 7 is a continued view of FIG. 6, illustrating the body furthermore continuously rotating in the driving direction indicated by the arrow to cause the ratchet wrench to be operated from the third position to the first position.
Figure 8:
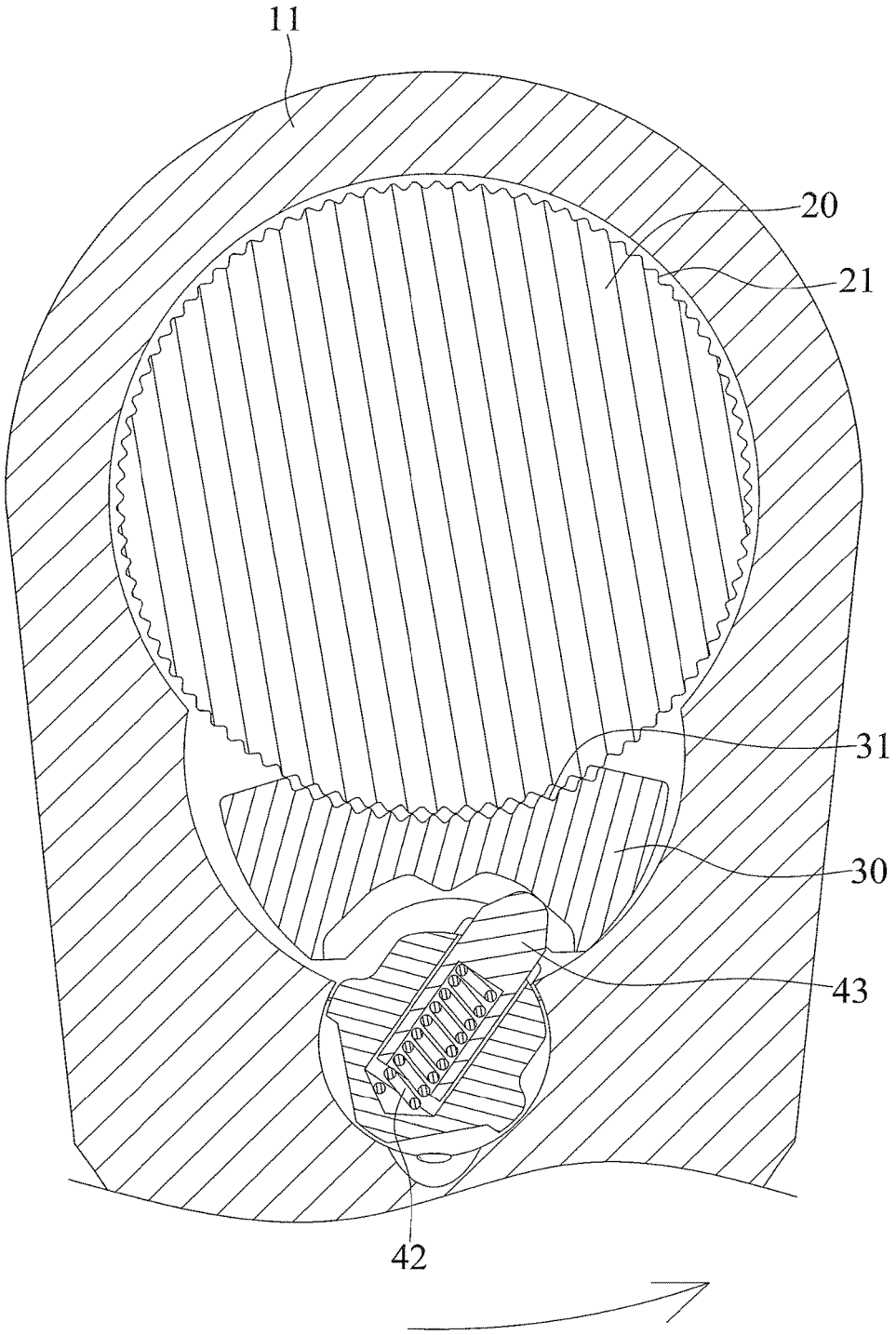
FIG. 8 is a continued view of FIG. 7, illustrating the body rotating in the non-driving direction indicated by another arrow.

When the ratchet wrench is operated in the non-driving direction (as shown in FIGS. 7 and 8), the ratchet wheel 20 rotated in relation to the body 10 pushing the pawl 30 to move toward the third receiving recess 113. The plurality of second toothed portions 31 of the pawl 30 is disengaged from the plurality of first toothed portions 21 of the ratchet wheel 20 to provide a ratchet function.

Thus since the illustrative embodiments disclosed herein may be embodied in other specific forms without departing from the spirit or general characteristics thereof, some of which forms have been indicated, the embodiments described herein are to be considered in all respects illustrative and not restrictive. The scope is to be indicated by the appended claims, rather than by the foregoing description, and all changes which come within the meaning and range of equivalency of the claims are intended to be embraced therein.

The invention claimed is:

1. A ratchet wrench comprising:

a body including a head having first and second receiving recesses interconnected with each other, with the first receiving recess extended along a first longitudinal axis, with the second receiving recess having a first abutting face;

a ratchet wheel rotatably and movably mounted in the first receiving recess and extended along a second longitudinal axis, with the ratchet wheel including a plurality of first toothed portions; and a pawl slideably received in the second receiving recess and including a plurality of second toothed portions and a first contact face, with the plurality of second toothed portions engaged with the plurality of first toothed portions, with the first contact face abutting against the first abutting face of the second receiving recess, with a first gap formed between the first abutting face of the second receiving recess and the first contact face of the pawl, with the first gap expanded from one end of the first abutting face to another end of the first abutting face adjacent to the ratchet wheel;

wherein the ratchet wrench is operable between a first position, a second position and a third position;

wherein the first gap is formed between the first abutting face and the first contact face in the first position or the second position;

wherein the pawl is compressed between the first abutting face and the ratchet wheel in the third position, wherein the pawl is elastically deformed in the third position, and wherein the first abutting face abuts against the first contact face to remove the first gap in the third position;

wherein the first and second longitudinal axes are collinear in the first position, wherein the first contact face abuts against the first abutting face in the first position, and wherein the plurality of second toothed portions of the pawl is engaged with the plurality of first toothed portions of the ratchet wheel in the first position;

wherein when the ratchet wrench is operated to withstand a torque load and to move from the first position to the second position, the pawl slides along the first abutting face from one side of the second receiving recess to another side of the second receiving recess adjacent to the first abutting face, wherein the ratchet wheel is pushed by the pawl, wherein the first and second longitudinal axes are parallel to each other, and wherein the pawl is limited between the ratchet wheel and the first abutting face.

2. The ratchet wrench as claimed in claim 1, with a first hardness of the body and a second hardness of the ratchet wheel both greater than a third hardness of the pawl.

3. The ratchet wrench as claimed in claim 1, with the body further including a handle connected to the head, with the handle extended along a horizontal axis, with the first abutting face curvely extended about a first centre, with the horizontal axis extending through the first centre, with the first contact face curvely extended about a second centre, and with the first contact face and the second centre respectively disposed at two opposite sides of the horizontal axis in the first position;

wherein the first contact face linearly contacts with the first abutting face along a thickness direction of the pawl in the first position.

4. The ratchet wrench as claimed in claim 3, with a first distance formed between the first contact face and the second centre greater than a second distance formed between the first abutting face and the first centre in the first position.

5. The ratchet wrench as claimed in claim 1, with the second receiving recess further having a second abutting face, with the first and second abutting faces respectively disposed at two opposite sides of the second receiving recess, with the pawl further including a second contact face, with the plurality of second toothed portions disposed between the first and second contact faces, with the second contact face abutting against the second abutting face of the second receiving recess, with a second gap formed between the second abutting face of the second receiving recess and the second contact face of the pawl, with the second gap gradually expanded from one end of the second abutting face to another end of the second abutting face adjacent to the ratchet wheel, and wherein the pawl abuts against the first abutting face or the second abutting face of the second receiving recess to change a driving direction and a non-driving direction of the body;

wherein the ratchet wheel rotates jointly with the body while the body rotates in the driving direction, and wherein the body rotates relative to the ratchet wheel when the body rotates in the non-driving direction.

6. The ratchet wrench as claimed in claim 5, with the head further having a third receiving recess interconnected with the second receiving recess, with the second receiving recess arranged between the first and third receiving recesses; and with the ratchet wrench further comprising:

a reversible device including a switch button pivotally received in the third receiving recess, a first elastic member, and a pressing member, with the switch button including a receptacle, with the first elastic member and the pressing member received in the receptacle, and with the pressing member biased by the first elastic member to press against a side of the pawl opposite to the ratchet wheel.

7. The ratchet wrench as claimed in claim 6, with the pawl further including a guiding groove arranged at one side thereof adjacent to the third receiving recess and located between the first and second contact faces, with the guiding groove including a first recessed portion disposed adjacent to the first contact face, and a second recessed portion disposed adjacent to the second contact face, and with the pressing member pressing against the first recessed portion or the second recessed portion to abut the pawl against the first abutting face or the second abutting face of the second receiving recess.

8. The ratchet wrench as claimed in claim 7, with the guiding groove further including a first restricting edge, a second restricting edge, and a bulge portion, with the first and second recessed portions disposed between the first and second restricting edges, with the first and second restricting edges and the bulge portion extended toward the reversible device, and with the pressing member limited by the first and second restricting edges to be unable to disengage from the first recessed portion or the second recessed portion.

9. The ratchet wrench as claimed in claim 6, with the switch button including a positioning portion extended therefrom, and with the positioning portion abutting against two opposite ends of the second receiving recess adjacent to the third receiving recess to limit a pivoting angle of the switch button while the switch button is operable to pivot relative to the head.

10. The ratchet wrench as claimed in claim 6, with the switch button further including two abutting surfaces disposed at one side thereof opposite to the second receiving recess, with the two abutting surfaces perpendicular to each other, with the head further including a slot interconnected with the third receiving recess, with the reversible device further including a second elastic member and an abutting member received in the slot, and with the abutting member biased by the second elastic member to press against one of the two abutting surfaces.

* * * * *